US006800103B2

(12) United States Patent
Malfer et al.

(10) Patent No.: US 6,800,103 B2
(45) Date of Patent: Oct. 5, 2004

(54) SECONDARY AMINE MANNICH DETERGENTS

(75) Inventors: Dennis J. Malfer, Glen Allen, VA (US); Andrea T. Noble, Midlothian, VA (US); William J. Colucci, Glen Allen, VA (US); Roger M. Sheets, Glen Allen, VA (US)

(73) Assignee: Ethyl Corporation, Richmond, VA (US)

( * ) Notice: Subject to any disclaimer, the term of this patent is extended or adjusted under 35 U.S.C. 154(b) by 149 days.

(21) Appl. No.: 09/776,036

(22) Filed: Feb. 2, 2001

(65) Prior Publication Data

US 2002/0134006 A1 Sep. 26, 2002

(51) Int. Cl.[7] ..... C10L 1/18; C10L 1/22
(52) U.S. Cl. ..... 44/415; 44/424; 564/336
(58) Field of Search ..... 44/415, 424; 564/336

(56) References Cited

U.S. PATENT DOCUMENTS

| | | | | |
|---|---|---|---|---|
| 3,368,972 | A | | 2/1968 | Otto |
| 3,649,229 | A | | 3/1972 | Otto |
| 3,877,889 | A | | 4/1975 | Dix |
| 3,948,619 | A | | 4/1976 | Worrel |
| 3,994,698 | A | | 11/1976 | Worrel |
| 4,038,043 | A | | 7/1977 | Garth |
| 4,116,644 | A | | 9/1978 | Jackisch et al. |
| 4,117,011 | A | | 9/1978 | Malec |
| 4,231,759 | A | | 11/1980 | Udelhofen et al. |
| 4,334,085 | A | | 6/1982 | Basalay et al. |
| 4,892,563 | A | | 1/1990 | Chibnik |
| 5,634,951 | A | | 6/1997 | Colucci et al. |
| 5,697,988 | A | | 12/1997 | Malfer et al. |
| 5,725,612 | A | * | 3/1998 | Malfer et al. ..... 44/415 |
| 5,876,468 | A | | 3/1999 | Moreton |
| 5,944,858 | A | | 8/1999 | Wallace |
| 6,179,885 | B1 | | 1/2001 | McAtee |

FOREIGN PATENT DOCUMENTS

| | | |
|---|---|---|
| CA | 2089833 | 8/1993 |
| EP | 0 042 589 A1 | 12/1981 |
| EP | 0 182 940 A1 | 6/1986 |
| EP | 0 440 507 A2 | 2/1991 |
| EP | 0 647 700 A1 | 4/1995 |
| EP | 0 870 819 A2 | 4/1998 |
| EP | 1 008 642 A1 | 10/1999 |
| WO | WO 01/25293 | 4/2001 |
| WO | WO 01/25294 | 4/2001 |
| WO | WO 01/42399 A1 | 6/2001 |

* cited by examiner

*Primary Examiner*—Cephia D. Toomer
(74) *Attorney, Agent, or Firm*—Dennis H. Rainear; Leah O. Robinson

(57) ABSTRACT

New, highly effective detergent/dispersants for use in spark-ignition fuels comprising Mannich condensation products formed from (i) at least one substituted hydroxyaromatic compound having on the ring both (a) an aliphatic hydrocarbyl substituent derived from a polyolefin having a number average molecular weight in the range of about 500 to about 3000, and (b) a $C_{1-4}$ (ii) at least one secondary amine; and (iii) at least one aldehyde are described. Carrier such as ploy(oxyalkylene) compounds further enhance the effectiveness of these Mannich condensation products in minimizing or reducing intake valve deposits and/or intake valve sticking.

51 Claims, No Drawings

SECONDARY AMINE MANNICH DETERGENTS

TECHNICAL FIELD

This invention relates to novel Mannich base condensation products and fuel compositions comprising said Mannich products that are effective in controlling intake valve deposits and minimizing valve sticking in internal combustion engines.

BACKGROUND

Despite extensive prior research activities on Mannich base fuel additives carried out over the years, a need exists for Mannich base compositions having superior performance capabilities and superior physical properties. In particular, a most welcome contribution to the art would be the provision of Mannich base compositions that are highly effective in controlling intake valve deposits in internal combustion engines, that are capable of minimizing valve sticking under standard qualification test conditions, that require, and in many cases perform better with, smaller amounts of liquid carrier fluids than are conventionally used, and that provide all of these advantages at attractive competitive costs.

This invention is deemed to constitute such a contribution. The Mannich base additives of the present invention are more active in controlling and reducing intake valve deposits than some other Mannich base products. The Mannich products of the present invention also have lower viscosities compared to other Mannich products which provides additional benefits to the product.

SUMMARY OF THE INVENTION

This invention is based on the discovery that Mannich condensation products having superior performance characteristics and excellent physical properties can be formed by selection of certain amines and hydroxyaromatic compounds to be used in the condensation reaction and by using the reactants in specific proportions relative to each other to make pure compounds with minimal undesired byproducts, which may adversely impact the performance of the additives. Further, it has been discovered that by using a di-substituted hydroxyaromatic compound which has only one site for the Mannich reaction to occur, i.e., only one ortho- or para-position being unsubstituted, in combination with a secondary amine having only one hydrogen capable of entering into the Mannich reaction, products are obtained which are more effective at controlling intake valve deposits on an active/active basis compared to Mannich base products derived from a hydroxyaromatic compound having two or three reactive sites or Mannich base products derived from primary amines or amines having more than one active hydrogen. The term "active" when used to describe the Mannich reaction products means the total mass of products, regardless of chemical identity but not including solvent. Therefore, compounds of the present invention are more effective at controlling intake valve deposits than compounds derived from a hydroxyaromatic compound substituted in only one position, or containing a different amine, when both Mannich products contain equivalent amounts of amine-containing products. Also, the desired Mannich base products of the present invention can be made in higher yields compared to products made from a hydroxyaromatic compound substituted in only one position or one made from an amine having more than one reactive hydrogen.

Thus, in one of its embodiments this invention provides a Mannich product obtained by reacting a mixture of (i) at least one substituted hydroxyaromatic compound having on the ring both (a) an aliphatic hydrocarbyl substituent derived from a polyolefin having a number average molecular weight in the range of about 500 to about 3000, and (b) a $C_{1-4}$ alkyl; (ii) at least one secondary amine; and (iii) at least one aldehyde. In one embodiment, components (ii) and (iii) may be pre-reacted to form an intermediate prior to addition of (i). Preferred products of this type are formed by heating a mixture formed from (i), (ii) and (iii), at a temperature above about 40° C. at which a Mannich condensation reaction takes place.

Another embodiment of this invention is a fuel additive composition which comprises:

a) a Mannich product as described above, and b) at least one liquid carrier or induction aid therefor, most preferably at least one poly(oxyalkylene) compound, having an average molecular weight in the range of about 500 to about 3000.

Still another embodiment includes fuels for spark ignition engines into which have been blended the various compositions of this invention described herein, and methods for minimizing or reducing intake valve deposits and/or minimizing or reducing intake valve sticking in an internal combustion engine by fueling and/or operating the engine with a fuel composition of this invention.

In additional preferred embodiments of this invention the Mannich product is obtained by reacting a di-substituted hydroxyaromatic compound in which the hydrocarbyl substituent (a) comprises polypropylene, polybutylene or an ethylene alpha-olefin copolymer having a number average molecular weight in the range of about 500 to about 3000 and a polydispersity in the range of about 1 to about 4, one or more secondary amines, and at least one aldehyde. Because of outstanding effectiveness in the control (i.e., reduction or minimization) of the weight of deposits formed on intake valves during engine operation, an especially preferred embodiment involves use of dibutyl amine as the secondary amine, formaldehyde or formalin as the aldehyde, and a molar ratio of the above substituted hydroxyaromatic compound to dibutyl amine to formaldehyde of 1:0.8-1.5:0.8-1.5, respectively. A more preferred molar ratio for these last-named reactants is 0.9 to 1.2 moles of the dibutyl amine and 0.9 to 1.2 moles of aldehyde per mole of the above di-substituted hydroxyaromatic compound. Such Mannich base reaction products have given superlative results in an extensive number of tests.

Other embodiments and features of this invention will become still further apparent from the ensuing description and appended claims.

DETAILED DESCRIPTION

Mannich Base Reaction Product

Representative di-substituted hydroxyaromatic compounds used in forming the Mannich base products of the present invention are represented by the following formula:

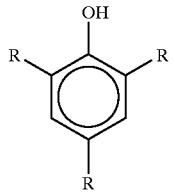

in which R is H, $C_{1-4}$ alkyl, or a hydrocarbyl substituent having a number average molecular weight in the range of about 500 to about 3000, with the proviso that one R is H, one R is a $C_{1-4}$ alkyl and one R is a hydrocarbyl substituent. It has been discovered that by using a substituted hydroxyaromatic compound which has only one site for the Mannich reaction to occur, i.e., only one ortho- or para-position being unsubstituted (i.e., where one R=H) in combination with a secondary amine, as defined herein, products are obtained that are very effective at reducing intake valve deposits. Further, the Mannich base products of the present invention can be made in higher yields compared to products made from a hydroxyaromatic compound substituted in only one position (for example, hydroxyaromatic compounds where one R is a hydrocarbyl substituent and two R's are H such as a hydrocarbyl-substituted phenol).

Representative hydrocarbyl substituents include polypropylene, polybutene, polyisobutylene, and ethylene alpha-olefin copolymers). Other similar long-chain hydrocarbyl substituents may also be used. Examples include copolymers of butylene and/or isobutylene and/or propylene, and one or more mono-olefinic comonomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene or such butenes may be aliphatic and can also contain non-aliphatic groups, e.g., styrene, o-methylstyrene, p-methylstyrene, divinyl benzene and the like. Thus in any case the resulting polymers and copolymers used in forming the di-substituted hydroxyaromatic compound are substantially aliphatic hydrocarbon polymers. Polybutylene is preferred. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polyisobutenes having relatively high proportions of polymer molecules having a terminal vinylidene group, i.e. at least 20% of the total terminal olefinic double bonds in the polyisobutene comprise an alkylvinylidene isomer, preferably at least 50% and more preferably at least 70%, formed by methods such as described, for example, in U.S. Pat. No. 4,152,499 and W. German Offenlegungsschrift 29 04 314, are preferred polyalkenes for use in forming the hydrocarbyl substituted hydroxyaromatic reactant. Also suitable for use in forming the long chain substituted hydroxyaromatic reactants of the present invention are ethylene alpha-olefin copolymers having a number average molecular weight of 500 to 3000, wherein at least about 30% of the polymer's chains contain terminal ethylidene unsaturation.

A preferred di-substituted hydroxyaromatic compound can be obtained by alkylating o-cresol with the high molecular weight hydrocarbyl polymers described above.

The alkylation of the substituted hydroxyaromatic compound is typically performed in the presence of an alkylating catalyst such as $BF_3$ at a temperature in the range of about 30 to about 200° C. The hydrocarbyl substituents on the aromatic ring of the hydroxyaromatic compound are derived from a polyolefin having a number average molecular weight (Mn) of from about 500 to about 3000, preferably from about 500 to about 2000, as determined by GPC. It is also preferred that the polyolefin used have a polydispersity in the range of about 1 to about 4, preferably from about 1 to about 2, as determined by GPC. Suitable methods of alkylating the hydroxyaromatic compounds of the present invention are well known in the art, for example, as taught in GB 1,159,368 and U.S. Pat. Nos. 4,238,628; 5,300,701 and 5,876,468.

A preferred configuration of the di-substituted hydroxyaromatic compound is that of a hydrocarbyl substituent in the para-position and the $C_{1-4}$ alkyl substituent in one of the ortho-positions. However, any di-subtituted hydroxyaromatic compound readily reactive in the Mannich condensation reaction may be employed. The hydrocarbyl substituents may contain some residual unsaturation, but in general, are substantially saturated.

A very important feature of this invention is the use of secondary amines having only one amino group in the molecule capable of entering into the Mannich condensation reaction with the di-substituted hydroxyaromatic compound and the aldehyde, wherein that amino group is a secondary amino group.

Secondary amines for use in the present invention may be represented by the following formula:

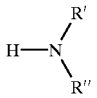

wherein R' and R" are each independently alkyl, cycloalkyl, aryl, alkaryl and aralkyl groups having from 1 to 30 carbon atoms, preferably 1 to 18 carbon atoms, more preferably 1 to 6 carbon atoms. Representative amines suitable for use in the present invention include dimethylamine, diethylamine, dipropylamine, dibutylamine, dipentylamine and dicyclohexylamine. Dibutylamine is preferred.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde and formalin.

The condensation reaction among the di-substituted hydroxyaromatic compound, the secondary amine(s) and the aldehyde is conducted at a temperature in the range of about 40 to about 200° C. The reaction can be conducted in bulk (no diluent or solvent) or in a solvent or diluent. Water is evolved and can be removed by azeotropic distillation during the course of the reaction. Typical reaction times range from 2 to 4 hours, although longer or shorter times can be used as necessary.

As noted above, an important feature of this invention is the proportions of the reactants in the Mannich condensation reaction mixture. Preferred proportions of reactants (i), (ii) and (iii) are 1 mole of the di-substituted hydroxyaromatic compound (i), from 0.8 to 1.5 mole part(s) of at least one secondary amine (ii), and from 0.8 to 1.5 mole part(s) of at least one aldehyde (iii); more preferably a mole ratio of (i):(ii):(iii) of 1:0.9-1.2:0.9-1.2; most preferably 1:1.0-1.15:1.0-1.15. In a preferred embodiment, the mole ratio of aldehyde to amine is 1.2:1 or less, preferably 1.1:1 or less and more preferably 1.2:1 to 1:1. When performing the reactions on a laboratory scale the foregoing ratios are relatively easy to maintain and control. However, when performing the reaction in large scale plant reactors, the possibility of losses of the more volatile reactants (amine and formaldehyde) can be encountered, as by vaporization into the reactor headspace, entrainment in purge streams as water is being purged from the reaction mixture, etc. Thus when conducting the reaction on a large scale care should be exercised to compensate for any such losses so that the liquid reaction mixture actually contains the reactants in the proportions utilized pursuant to this invention. Variations from the above reactant proportions may occur, however, if less than 1 mole of amine and aldehyde are used per mole of hydroxyaromatic compound some hydroxyaromatic compound will remain unreacted and the Mannich product will not be as active. If higher ratios of amine and/or aldehyde are used, undesired byproducts may form or unreacted amine or aldehydes may be present in the finished product or stripped from the reaction mixture resulting in a waste of starting materials.

In one embodiment, the present invention is directed to a composition of matter of the formula:

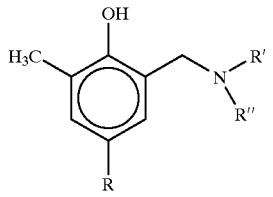

wherein R comprises a hydrocarbyl substituent having a number average molecular weight in the range of about 500 to about 3000; and R' and R" are independently alkyl groups having from 1 to 30 carbon atoms; as well as fuels and fuel additive compositions comprising said composition of matter.

The Mannich products of this invention are preferably used in combination with a liquid carrier, induction aid or fluidizer. Such carriers can be of various types, such as for example liquid poly-α-olefin oligomers, liquid polyalkene hydrocarbons (e.g., polypropene, polybutene, polyisobutene, or the like), liquid hydrotreated polyalkene hydrocarbons (e.g., hydrotreated polypropene, hydrotreated polybutene, hydrotreated polyisobutene, or the like), mineral oils, liquid poly(oxyalkylene) compounds, liquid alcohols or polyols, liquid esters, and similar liquid carriers or solvents. Mixtures of two or more such carriers or solvents can be employed.

Preferred liquid carriers because of their performance capabilities are 1) a mineral oil or a blend of mineral oils that have a viscosity index of less than about 120, 2) one or a blend of poly-α-olefin oligomers, 3) one or more poly (oxyalkylene) compounds having an average molecular weight in the range of about 500 to about 3000, 4) one or more polyalkenes or 5) mixtures of any of 1), 2), 3) and 4).

The mineral oil carriers that can be used include paraffinic, naphthenic and asphaltic oils, and can be derived from various petroleum crude oils and processed in any suitable manner. For example, the mineral oils may be solvent extracted or hydrotreated oils. Reclaimed mineral oils can also be used. Hydrotreated oils are the most preferred. Preferably the mineral oil used has a viscosity at 40° C. of less than about 1600 SUS, and more preferably between about 300 and 1500 SUS at 40° C. Paraffinic mineral oils most preferably have viscosities at 40° C. in the range of about 475 SUS to about 700 SUS. For best results it is highly desirable that the mineral oil have a viscosity index of less than about 100, more preferably, less than about 70 and most preferably in the range of from about 30 to about 60.

The poly-α-olefins (PAO) which are included among the preferred carrier fluids are the hydrotreated and unhydrotreated poly-α-olefin oligomers, i.e., hydrogenated or unhydrogenated products, primarily trimers, tetramers and pentamers of α-olefin monomers, which monomers contain from 6 to 12, generally 8 to 12 and most preferably about 10 carbon atoms. Their synthesis is outlined in *Hydrocarbon Processing*, February 1982, page 75 et seq., and in U.S. Pat. Nos. 3,763,244; 3,780,128; 4,172,855; 4,218,330; and 4,950,822. The usual process essentially comprises catalytic oligomerization of short chain linear alpha olefins (suitably obtained by catalytic treatment of ethylene). The poly-α-olefins used as carriers will usually have a viscosity (measured at 100° C.) in the range of 2 to 20 centistokes (cSt). Preferably, the poly-α-olefin has a viscosity of at least 8 cSt, and most preferably about 10 cSt at 100° C.

The poly(oxyalkylene) compounds which are among the preferred carrier fluids for use in this invention are fuel-soluble compounds which can be represented by the following formula $$R_1—(R_2—O)_n—R_3$$

wherein $R_1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R_2$ is an alkylene group having 2-10 carbon atoms (preferably 2–4 carbon atoms), $R_3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 and preferably in the range of from 3 to 120 representing the number (usually an average number) of repeating alkyleneoxy groups. In compounds having multiple —$R_2$—O— groups, $R_2$ can be the same or different alkylene group and where different, can be arranged randomly or in blocks. Preferred poly(oxyalkylene) compounds are monools comprised of repeating units formed by reacting an alcohol with one or more alkylene oxides, preferably one alkylene oxide.

The average molecular weight of the poly(oxyalkylene) compounds used as carrier fluids is preferably in the range of from about 500 to about 3000, more preferably from about 750 to about 2500, and most preferably from above about 1000 to about 2000.

One useful sub-group of poly(oxyalkylene) compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being incorporated herein by reference as if fully set forth.

A preferred sub-group of poly(oxyalkylene) compounds is comprised of one or a mixture of alkylpoly(oxyalkylene) monools which in its undiluted state is a gasoline-soluble liquid having a viscosity of at least about 70 centistokes (cSt) at 40° C. and at least about 13 cSt at 100° C. Of these compounds, monools formed by propoxylation of one or a mixture of alkanols having at least about 8 carbon atoms, and more preferably in the range of about 10 to about 18 carbon atoms, are particularly preferred.

The poly(oxyalkylene) carriers used in the practice of this invention preferably have viscosities in their undiluted state of at least about 60 cSt at 40° C. (more preferably at least about 70 cSt at 40° C.) and at least about 11 cSt at 100° C. (more preferably at least about 13 cSt at 100° C.). In addition, the poly(oxyalkylene) compounds used in the practice of this invention preferably have viscosities in their undiluted state of no more than about 400 cSt at 40° C. and no more than about 50 cSt at 100° C. More preferably, their viscosities will not exceed about 300 cSt at 40° C. and will not exceed about 40 cSt at 100° C. The most preferred poly(oxyalkylene) compounds will have viscosities of no more than about 200 cSt at 40° C., and no more than about 30 cSt at 100° C.

Preferred poly(oxyalkylene) compounds are poly (oxyalkylene) glycol compounds and monoether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkylene groups in the molecule are derived from 1,2-propylene oxide. Details concerning preparation of such poly(oxyalkylene) compounds are referred to, for example, in Kirk-Othmer, *Encyclopedia of Chemical Technology*, Third Edition, Volume 18, pages 633–645 (Copyright 1982 by John Wiley & Sons), and in references cited therein, the foregoing excerpt of the Kirk-Othmer encyclopedia and the references cited therein being incorporated herein in toto by reference. U.S. Pat. Nos. 2,425,755; 2,425,845; 2,448,664; and 2,457,139 also describe such procedures, and are also incorporated herein by reference as if fully set forth herein.

A particularly preferred sub-group of poly(oxyalkylene) compounds is comprised of one or a mixture of alkylpoly (oxyalkylene)monools which in its undiluted state is a gasoline-soluble liquid having a viscosity of at least about 70 centistokes (cSt) at 40° C. and at least about 13 cSt at 100° C. Typically the maximum viscosities at these temperatures are no more than about 400 cSt at 40° C. and no more than about 50 cSt at 100° C. More preferably, their viscosities will not exceed about 300 cSt at 40° C. and will not exceed about 40 cSt at 100° C. The most preferred poly(oxyalkylene) compounds will have viscosities of no more than about 200 cSt at 40° C., and no more than about 30 cSt at 100° C. Of these compounds, monools formed by propoxylation of one or a mixture of alkanols having at least about 8 carbon atoms, and more preferably in the range of about 10 to about 18 carbon atoms, are particularly preferred.

The poly(oxyalkylene) compounds used pursuant to this invention will contain a sufficient number of branched oxyalkylene units (e.g., methyldimethyleneoxy units and/or ethyldimethyleneoxy units) to render the poly(oxyalkylene) compound gasoline soluble.

Another group of preferred carriers is the liquid polyalkylenes such as polypropenes, polybutenes, polyisobutenes, polyamylenes, copolymers of propene and butene, copolymers of butene and isobutene, copolymers of propene and isobutene and copolymers of propene, butene and isobutene. Preferred polyalkylene carrier fluids include polybutenes having a molecular weight distribution of less than 1.4 as taught in U.S. Pat. No. 6,048,373. Use of materials of this general type together with other carrier fluids is described for example, in U.S. Pat. Nos. 5,089,028 and 5,114,435, the disclosures of which are incorporated herein by reference.

In some cases, the Mannich base detergent/dispersant can be synthesized in the carrier fluid. In other instances, the preformed detergent/dispersant is blended with a suitable amount of the carrier fluid. If desired, the detergent/dispersant can be formed in a suitable solvent or carrier fluid and then blended with an additional quantity of the same or a different carrier fluid.

The proportion of the liquid carrier used relative to the Mannich base in the preferred additive packages and fuel compositions of this invention is such that the fuel composition when consumed in an engine results in improved intake valve cleanliness as compared to intake valve cleanliness of the same engine operated on the same composition except for being devoid of the liquid carrier. Thus in general, the weight ratio of carrier fluid to Mannich base detergent/dispersant on an active ingredient basis, i.e. excluding solvent(s), if any, used in the manufacture of the Mannich base either during or after its formation but before addition of the carrier fluid, will usually fall within the range of about 0.3:1 to about 2.0:1, and preferably within the range of about 0.5:1 to about 1.5:1.

The Mannich products of the present invention have relatively low viscosities compared to Mannich products made from components outside the scope of the present invention. These lower viscosities provide formulation flexibility and improved performance in valve sticking tests. The lower viscosity allows for the use of reduced amounts of carrier fluids to pass low temperature valve sticking tests while maintaining excellent intake valve deposit control due to the increased detergency imparted by the Mannich product of the invention. The ability to reduce the level of carrier fluid allows for more active (higher detergent concentration) additive packages.

Typically the additive concentrates of this invention contain from about 12 to about 69 wt %, and preferably from about 22 to about 50 wt % of the Mannich base detergent/dispersant on an active ingredient basis. The additive concentrates may also contain carrier fluid, the level of which is determined by the desired carrier to Mannich base detergent/dispersant ratio.

When formulating the fuel compositions of this invention, the Mannich product and carrier fluid (with or without other additives) are employed in amounts sufficient to reduce or inhibit deposit formation in an internal combustion engine. Thus the fuels will contain minor amounts of the Mannich base detergent/dispersant and of the liquid carrier fluid proportioned as above that control or reduce formation of engine deposits, especially intake system deposits, and most especially intake valve deposits in spark-ignition internal combustion engines. Generally speaking the fuels of this invention will contain on an active ingredient basis as defined above, an amount of the Mannich base detergent/dispersant in the range of about 5 to about 300 ptb (pounds by weight of additive per thousand barrels by volume of fuel), and preferably in the range of about 10 to about 200 ptb. In the preferred fuel compositions wherein a liquid carrier fluid is used, the total amount of carrier fluid will preferably be present in an amount of from about 0.3 to about 2.0 parts by weight per part by weight of Mannich detergent/dispersant (on an active ingredient basis), more preferably the carrier fluid will be present in an amount of from about 0.4 to 1.0 parts by weight per one part of Mannich detergent/dispersant.

Other additives, such as one or more fuel-soluble antioxidants, demulsifying agents, rust or corrosion inhibitors, metal deactivators, combustion modifiers, alcohol cosolvents, octane improvers, emission reducers, friction modifiers, lubricity additives, ancillary detergent/dispersant additives, markers, dyes and multifunctional additives (e.g., methylcyclopentadienyl manganese tricarbonyl and/or other cyclopentadienyl manganese tricarbonyl compounds) can also be included in the fuels and additive concentrates of this invention. Whatever components are selected for use in the compositions of this invention, each component should be present in an amount at least sufficient for it to exert its intended function or functions in the finished fuel composition.

In a preferred embodiment, the additive concentrates additionally contain at least one inert hydrocarbon solvent having a boiling point below about 200° C.

The base fuels used in formulating the fuels of this invention are any and all base fuels suitable for use in the operation of spark ignition internal combustion engines such as unleaded motor and aviation gasolines, and so-called reformulated gasolines which typically contain both hydrocarbons of the gasoline boiling range and fuel-soluble oxygenated blending components such as alcohols, ethers, and other suitable oxygen-containing organic compounds. Preferred blending agents include fuel-soluble alkanols such as methanol, ethanol, and their higher homologs, and fuel-soluble ethers such as methyl tertiary butyl ether, ethyl tertiary butyl ether, methyl tertiary amyl ether, and analogous compounds, and mixtures of such materials. Oxygenates, when used, will normally be present in the base fuel in an amount below about 25% by volume, and preferably in an amount that provides an oxygen content in the overall fuel in the range of about 0.5 to about 5 percent by volume. However in the practice of this invention departures from these ranges of proportions are permissible whenever deemed necessary, appropriate or desirable.

The additives used in formulating the preferred fuels of this invention can be blended into the base fuel individually or in various sub-combinations. However, it is preferable to blend all of the components concurrently using an additive concentrate of this invention as this takes advantage of the mutual compatibility afforded by the combination of ingredients when in the form of an additive concentrate. Also use of a concentrate reduces blending time and lessens the possibility of blending errors.

EXAMPLES

The practice and advantages of this invention are demonstrated by the following examples which are presented for purposes of illustration and not limitation. In each Mannich condensation reaction the following general procedure was used. The Mannich reaction products of the present invention were prepared by reacting a long chain alkylated ortho-cresol ("PBC"), either dimethyl amine ("DMA") or dibutyl amine ("DBA"), and formaldehyde ("FA"). The PBC was formed by alkylating ortho-cresol with a polyisobutene having a number average molecular weight of approximately 900. Mannich reaction products outside of the scope of the present invention were prepared by reacting PBC, dimethylaminopropyl amine ("DMAPA"), and FA. The PBC and DMA, DBA or DMAPA were added to a resin kettle equipped with mechanized stirring, nitrogen feed, a Dean-Stark trap, and a heating mantle. Solvent, Aromatic 100 at 25% by weight of product, was introduced and the mixture was heated to 50° C. along with a slight exotherm. Next, 37% formaldehyde solution was added gradually, while vigorous stirring was maintained. A second, mild exotherm was noted. The reaction mixture was heated to reflux; about 102° C. The azeotropic blend of water and solvent was removed continuously over a period lasting one hour. The temperature was increased as required to sustain removal of water, then the reaction mixture was heated gradually to 150° C., while sparging with nitrogen. After reaction the viscous product mixture was weighed and diluted with Aromatic 100 solvent as desired.

The mole ratios of PBC:amine:FA for the DBA Mannich, the DMA Mannich and the DMAPA Mannich were 1.0:1.05:1.1.

Gasoline fuel compositions were subjected to engine tests whereby the substantial effectiveness of these compositions in minimizing intake valve deposit weight was conclusively demonstrated. The Mannich reaction products were combined with a polyoxyalkylene monool (polyether) carrier fluid or a mixed carrier fluid comprising a polyoxyalkylene monool and polybutene (PIB) and these components were added to the gasoline in amounts indicated in Table 1. The test series was performed using a Ford 2.3-liter engine operated on a test stand under standard operating conditions for determination of deposit formation on intake valves.

The detergents in Table 1 are referred to by the amine used to prepare the Mannich reaction product (DBA, DMA or DMAPA). The treat rates referred to in the Table are the sum of active detergent plus carrier fluid(s). The ratios set forth in the Table are the ratios of active detergent to carrier fluid(s). The effectiveness of the compositions of the present invention was rated in five different regular unleaded (RUL) fuels (A–E).

TABLE 1

2.3L IVD Engine test results

| | Fuel | Detergent | Carrier Fluid(s) | Treat (ptb) | Ratio of Detergent to Carrier | IVD (mg) |
|---|---|---|---|---|---|---|
| 1* | A | DMAPA | polyether | 72 | 1:0.8 | 56.95** |
| 2 | A | DBA | polyether | 72 | 1:0.8 | 27.6 |
| 3 | A | DMA | polyether | 72 | 1:0.8 | 52.1 |
| 4* | B | DMAPA | PIB/ polyether | 40 | 1:0.43:0.44 | 105.8 |
| 5 | B | DBA | PIB/ polyether | 40 | 1:0.43:0.44 | 69.0 |
| 6 | B | DBA | PIB/ polyether | 36 | 1:0.43:0.44 | 89.6 |
| 7* | C | DMAPA | polyether | 72 | 1:0.8 | 44.1** |
| 8 | C | DBA | polyether | 72 | 1:0.8 | 25.7 |
| 9 | C | DMA | polyether | 72 | 1:0.8 | 47.5 |
| 10* | D | DMAPA | polyether | 50 | 1:0.8 | 140.75** |
| 11 | D | DBA | polyether | 50 | 1:0.8 | 88.4** |
| 12* | E | DMAPA | polyether | 39 | 1:0.8 | 151.5 |
| 13 | E | DBA | polyether | 39 | 1:0.8 | 77.65** |

*Comparative example not within the scope of this invention
**Average of multiple runs It is clear, upon examination of the above Table, that the Mannich reaction products from secondary amines exhibit improved performance in the 2.3 liter IVD Engine test as demonstrated by the reduced amount of deposits obtained by using the Mannich reaction products of the present invention in a number of different fuels, at different treat rates and with different carrier fluid systems.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Likewise preformed additive concentrates, in which higher proportions of the additive components are blended together usually with one or more diluents or solvents, can be formed so that subsequently the concentrate can be blended with a base fuel in the course of forming the finished fuel composition. Accordingly, even though the claims hereinafter may refer to substances, components and/or ingredients in the present tense ("comprises", "is", etc.), the reference is to the substance, component or ingredient as it exists or may have existed at the time just before it was first blended or mixed with one or more other substances, components and/or ingredients in accordance with the present disclosure. The fact that the substance, component or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" means that the substance under discussion should be sufficiently soluble at 20° C. in the base fuel selected for use to reach at least the minimum concentration required to enable the substance to serve its intended function. Preferably the substance will have a substantially greater solubility in the base fuel than this. However, the substance need not dissolve in the base fuel in all proportions.

Each and every patent or other publication referred to in any portion of this specification is incorporated in toto into this disclosure by reference for all purposes, as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A Mannich reaction product obtained by reacting (i) ortho-cresol having on the ring an aliphatic hydrocarbyl substituent derived from a polyolefin having a number average molecular weight in the range of about 900 to about 3000; (ii) dibutylamine; and (iii) at least one aldehyde.

2. The Mannich product of claim 1 wherein the product is formed by heating a mixture of (i), (ii) and (iii) at a temperature above about 40° C.

3. The Mannich product of claim 1 wherein the mole ratio of (i):(ii):(iii) is 1:0.8-1.5:0.8-1.5.

4. The Mannich product of claim 3 wherein the mole ratio of (i):(ii):(iii) is 1:0.9-1.2:0.9-1.2.

5. The Mannich product of claim 4 wherein the mole ratio of (i):(ii):(iii) is 1:1.0-1.15:1.0-1.15.

6. The Mannich product of claim 1 wherein the mole ratio of aldehyde (iii) to amine (ii) is 1.2:1 or less.

7. The Mannich product of claim 6 wherein the mole ratio of aldehyde (iii) to amine (ii) is 1.1:1 or less.

8. The Mannich product of claim 6 wherein the mole ratio of aldehyde (iii) to amine (ii) is 1.2:1 to 1:1.

9. The Mannich product of claim 1 wherein the hydrocarbyl substituent on the ortho-cresol is derived from polypropylene, polybutylene or an ethylene alpha-olefin copolymer having a polydispersity in the range of about 1 to about 4.

10. The Mannich product of claim 9 wherein at least 20 percent of the terminal olefinic double bonds in the polybutylene are alkylvinylidene.

11. The Mannich product of claim 10 wherein at least 50 percent of the terminal olefinic double bonds in the polybutylene are alkylvinylidene.

12. The Mannich product of claim 11 wherein at least 70 percent of the terminal olefinic double bonds in the polybutylene are alkylvinylidene.

13. A fuel additive composition comprising:

a) a fuel soluble Mannich detergent/dispersant obtained by reacting (i) ortho-cresol having on the ring an aliphatic hydrocarbyl substituent derived from a polyolefin having a number average molecular weight in the range of about 900 to about 3000; (ii) dibutylamine; and (iii) at least one aldehyde; and b) at least one liquid carrier for said Mannich detergent/dispersant in proportions such that for each part by weight of Mannich detergent/dispersant on an active ingredient basis there is in the range of about 0.3 to about 2.0 parts by weight of liquid carrier therefor.

14. The composition of claim 13 wherein the Mannich detergent/dispersant is produced by heating a mixture formed from (i), (ii) and (iii), at a temperature above about 40° C.

15. The composition of claim 13 wherein the mole ratio of (i):(ii):(iii) is 1:0.8-1.5:0.8-1.5.

16. The composition of claim 15 wherein the mole ratio of (i):(ii):(iii) is 1:0.9-1.2:0.9-1.2.

17. The composition of claim 16 wherein the mole ratio of (i):(ii):(iii) is 1:1.0-1.15:1.0-1.15.

18. The composition of claim 13 wherein the mole ratio of aldehyde (iii) to amine (ii) is 1.2:1 or less.

19. The composition of claim 18 wherein the mole ratio of aldehyde (iii) to amine (ii) is 1.1:1 or less.

20. The composition of claim 18 wherein the mole ratio of aldehyde (iii) to amine (ii) is 1.2:1 to 1:1.

21. The composition of claim 13 wherein the liquid carrier comprises at least one member selected from the group consisting of mineral oil, poly-α-olefin oligomers, poly (oxyalkylene) compounds, polyalkenes and mixtures thereof.

22. The composition of claim 21 wherein the liquid carrier comprises at least one fuel-soluble poly(oxyalkylene) compound.

23. The composition of claim 22 wherein said poly (oxyalkylene) compound comprises at least one poly (oxyalkylene) monool formed from 1,2-alkylene oxide and one or more primary alcohols having at least 8 carbon atoms per molecule.

24. The composition of claim 23 wherein said poly (oxyalkylene) monool comprises at least one poly (oxypropylene) monool formed from 1,2-propylene oxide and one or more primary alcohols having at least 8 carbon atoms per molecule.

25. The composition of claim 21 wherein said liquid carrier comprises a mixture of at least one polyalkene and at least one poly(oxyalkylene) compound.

26. The composition of claim 13 further comprising at least one inert hydrocarbon solvent that has a boiling point or boiling range below about 200° C.

27. The composition of claim 13 wherein the hydrocarbyl substituent on the ortho-cresol is derived from polypropylene, polybutylene or an ethylene alpha-olefin copolymer having a polydispersity in the range of about 1 to about 4.

28. The composition of claim 27 wherein at least about 20 percent of the terminal olefinic double bonds in the polybutylene are alkylvinylidene.

29. The composition of claim 28 wherein at least about 50 percent of the terminal olefinic double bonds in the polybutylene are alkylvinylidene.

30. The composition of claim 29 wherein at least about 70 percent of the terminal olefinic double bonds in the polybutylene are alkylvinylidene.

31. A fuel composition for use in spark-ignition internal combustion engines comprising a spark-ignition fuel into which has been blended from about 5 to about 200 ptb of the Mannich product of claim 1.

32. A fuel composition for use in a spark-ignition internal combustion engine comprising a spark-ignition fuel into which has been blended:

a) a fuel-soluble Mannich detergent/dispersant obtained by reacting (i) at least one di-substituted hydroxyaromatic compound having on the ring both (a) an aliphatic hydrocarbyl substituent derived from a polyolefin having a number average molecular weight in the range of about 500 to about 3000, and (b) a $C_{1-4}$ alkyl; (ii) dibutylamine; and (iii) at least one aldehyde; and b) at least one liquid carrier for said Mannich detergent/dispersant in proportions such that for each part by weight of Mannich detergent/dispersant on an active ingredient basis there is in the range of about 0.3 to about 2.0 parts by weight of liquid carrier therefor; wherein a) and b) are present in an amount at least sufficient to reduce or minimize the weight of intake valve deposits in a spark-ignition internal combustion engine operated on said fuel composition.

33. The fuel composition of claim 32 wherein the Mannich detergent/dispersant is produced by heating a mixture formed from (i), (ii) and (iii), at a temperature above about 40° C.

34. The fuel composition of claim 32 wherein the mole ratio of (i):(ii):(iii) is 1:0.8-1.5:0.8-1.5.

35. The fuel composition of claim 34 wherein the mole ratio of (i):(ii):(iii) is 1:0.9-1.2:0.9-1.2.

36. The fuel composition of claim 35 wherein the mole ratio of (i):(ii):(iii) is 1:1.0-1.15:1.0-1.15.

37. The fuel composition of claim 32 wherein the mole ratio of aldehyde (iii) to amine (ii) is 1.2:1 or less.

38. The fuel composition of claim 37 wherein the mole ratio of aldehyde (iii) to amine (ii) is 1.1:1 or less.

39. The fuel composition of claim 37 wherein the mole ratio of aldehyde (iii) to amine (ii) is 1.2:1 to 1:1.

40. The fuel composition of claim 32 wherein the liquid carrier comprises at least one member selected from the group consisting of mineral oil, poly-α-olefin oligomers, poly(oxyalkylene) compounds, polyalkenes and mixtures thereof.

41. The fuel composition of claim 40 wherein the liquid carrier is at least one fuel-soluble poly(oxyalkylene) compound.

42. The fuel composition of claim 41 wherein said at least one poly(oxyalkylene) compound is at least one poly (oxyalkylene) monool formed from 1,2-alkylene oxide and one or more primary alcohols having at least 8 carbon atoms per molecule.

43. The fuel composition of claim 42 wherein said at least one poly(oxyalkylene) monool is at least one poly (oxypropylene) monool formed from 1,2-propylene oxide and one or more primary alcohols having at least 8 carbon atoms per molecule.

44. The fuel composition of claim 40 wherein said liquid carrier comprises a mixture of at least one polyalkene and at least one poly(oxyalkylene) compound.

45. The fuel composition of claim 32 wherein the hydrocarbyl substituent on the ortho-cresol is derived from polypropylene, polybutylene or an ethylene alpha-olefin copolymer having a polydispersity in the range of about 1 to about 4.

46. A method of minimizing or reducing intake valve deposits in a spark-ignition internal combustion engine which comprises providing as fuel for the operation of said engine and operating said engine, a fuel composition in accordance with claim 32.

47. A method of minimizing or reducing intake valve sticking in a spark ignition internal combustion engine which comprises providing as fuel for the operation of said engine and operating said engine, a fuel composition in accordance with claim 32.

48. A composition of matter of the formula:

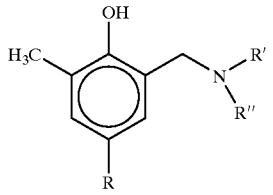

wherein R comprises a hydrocarbyl substituent having a number average molecular weight in the range of about 900 to about 3000; and R' and R" are each a butyl group.

49. The composition of matter of claim 48 wherein the hydrocarbyl substituent is derived from polypropylene, polybutylene or an ethylene alpha-olefin copolymer having a polydispersity in the range of about 1 to about 4.

50. A fuel additive composition comprising:

a) the composition of matter of claim 48; and b) at least one liquid carrier for said composition of matter in proportions such that for each part by weight of said composition of matter on an active ingredient basis there is in the range of about 0.3 to about 2.0 parts by weight of liquid carrier therefor.

51. A fuel composition for use in a spark-ignition internal combustion engine comprising a spark-ignition fuel into which has been blended:

a) a composition of matter according to claim 48; and b) at least one liquid carrier for said composition of matter in proportions such that for each part by weight of said composition of matter on an active ingredient basis there is in the range of about 0.3 to about 2.0 parts by weight of liquid carrier therefor; wherein a) and b) are present in an amount at least sufficient to reduce or minimize the weight of intake valve deposits in a spark-ignition internal combustion engine operated on said fuel composition.

* * * * *